US008647041B2

(12) United States Patent
Ummel, Jr.

(10) Patent No.: US 8,647,041 B2
(45) Date of Patent: Feb. 11, 2014

(54) METHOD AND APPARATUS FOR HANDLING REFUSE CONTAINERS

(76) Inventor: Tommy Lee Ummel, Jr., Grand Island, NE (US)

( * ) Notice: Subject to any disclaimer, the term of this patent is extended or adjusted under 35 U.S.C. 154(b) by 652 days.

(21) Appl. No.: 12/539,164

(22) Filed: Aug. 11, 2009

(65) Prior Publication Data

US 2011/0038696 A1 Feb. 17, 2011

(51) Int. Cl.
*B65B 21/02* (2006.01)

(52) U.S. Cl.
USPC ..... 414/406; 414/408; 414/501; 414/810

(58) Field of Classification Search
USPC ..... 414/406, 408, 501, 555, 810, 607; 294/68.3, 119.1
See application file for complete search history.

(56) References Cited

U.S. PATENT DOCUMENTS 4,175,903 A * 11/1979 Carson ..... 414/408
4,479,751 A 10/1984 Wyman et al.
4,969,813 A 11/1990 Lee et al.
5,033,930 A * 7/1991 Kraus ..... 414/408
5,266,000 A * 11/1993 LeBlanc, Jr. ..... 414/408
5,333,984 A * 8/1994 Bayne et al. ..... 414/408
D376,235 S 12/1996 Presnell
5,639,201 A 6/1997 Curotto
7,210,890 B2 5/2007 Curotto et al.
7,273,340 B2 9/2007 Arrez et al.
7,390,159 B2 * 6/2008 Rimsa et al. ..... 414/408
2010/0183410 A1 * 7/2010 Curotto ..... 414/408

* cited by examiner

*Primary Examiner* — Saul Rodriguez
*Assistant Examiner* — Willie Berry, Jr.
(74) *Attorney, Agent, or Firm* — Suiter Swantz pc llo

(57) ABSTRACT

To collect refuse, a portable material container gripper is mounted to lift arms of a refuse collection truck. The portable material container gripper is easily mounted to the lift arms by inserting a tube around the lift arms and locking it in place with a bar passing through an opening in the tube. The portable material container gripper includes a clamp that clamps around a horizontal bar on a refuse or material container to hold the refuse or material container in place while it is dumped into the bed of the refuse collection truck by the lift arms.

14 Claims, 10 Drawing Sheets

18
80
82
26
22
42
46
74
48
28
14

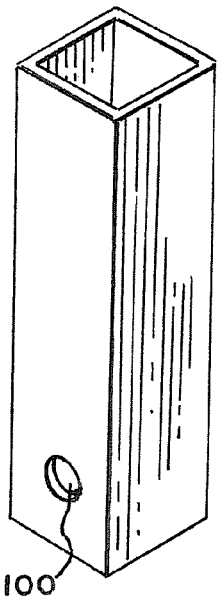
FIG. 21
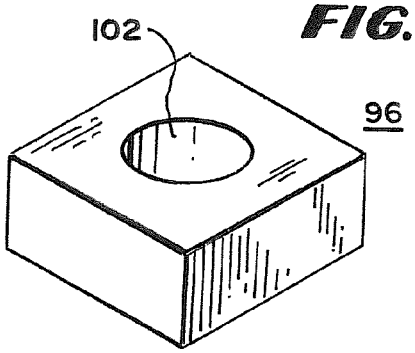
FIG. 22
FIG. 23
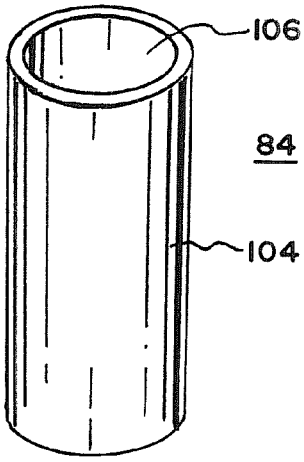
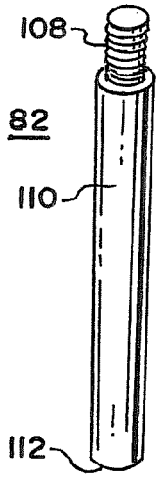
FIG. 24
FIG. 25
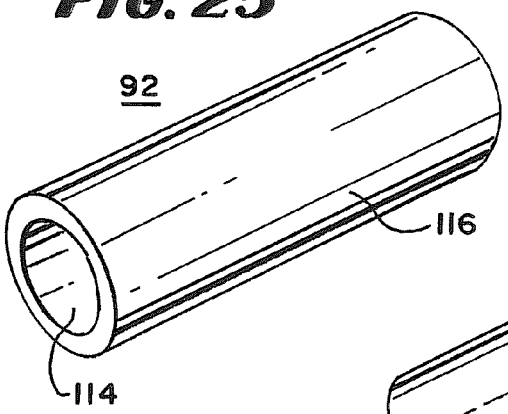
FIG. 26
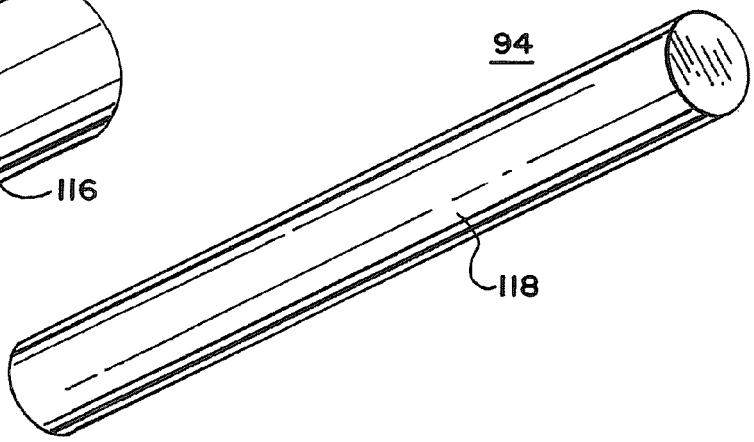

METHOD AND APPARATUS FOR HANDLING REFUSE CONTAINERS

BACKGROUND OF THE INVENTION

Material collection apparatus including a truck with a front or side loader are well known, particularly for refuse collection. One class of refuse collection apparatuses and methods utilizes special containers which are filled by the customers of a refuse collection company. Front loading or side loading vehicles go from customer to customer and empty the containers into the truck bed.

In one prior art material collector of this class, multiple part units are mounted permanently to a vehicle. These multipart units grip material containers or slide into pockets built into the material containers. Generally, the material containers are trash containers. Prior art systems of this type are disclosed in U.S. Pat. Nos. 7,210,890 and 5,639,201. These systems have a disadvantage in that if either the vehicle or the multipart unit for gripping the containers is not operable, then neither the vehicle nor the multipart gripping apparatus are usable. The only substitute is another vehicle containing the apparatus for picking up the material containers.

SUMMARY OF THE INVENTION

Accordingly, it is an object of the invention to provide a novel trash can gripper.

It is a still further object of the invention to provide a novel method of collecting material.

It is a still further object of the invention to provide a novel method of emptying containers.

It is a still further object of the invention to provide a novel material collection system.

It is a still further object of the invention to provide a novel container dumping system.

It is a still further object of the invention to provide a portable container gripper which may be carried to a vehicle and used by the vehicle to grip a series of containers, one after the other.

It is a still further object of the invention to provide a material collection system which may quickly move from location to location to collect material.

It is a still further object of the invention to provide a material dumping system which has a very short time duration dumping cycle.

It is a still further object of the invention to provide a container gripper for a collection system which is easily connected and disconnected from vehicles and may attach a series of containers to the vehicles to which it is attached.

It is a still further object of the invention to provide a container gripper which can be used for different types of containers such as commercial heavy containers or lighter containers.

It is a still further object of the invention to provide a material collection system which operates from the front of a vehicle to dump material into a bed of the vehicle in a process that permits the operator of the vehicle to see the material that is being dumped.

In accordance with the above and further objects of the invention, a lightweight gripper is provided. The lightweight gripper can be carried by a single person and mounted to a lift arm of a vehicle by one person in a simple operation. The gripper contains an easily actuated mechanism for gripping containers that are equipped with a standard gripping bar. The gripper is actuated with a lever operated by a single person to grip a container. The container can be locked in place with a simple locking mechanism. After the container is dumped by the vehicle, it can be easily unlocked and the gripper used for another container.

From the above description, it can be understood that the collection system of this invention has several advantages, such as: (1) it has a very short cycle time for emptying a container of less than ten seconds long, such as only a few seconds long; (2) the gripper is portable and may be utilized on many different vehicles; (3) the gripper can be carried by one person, mounted to a lift arm of a vehicle by one person and may grip a can by a simple lever operation by one person; and (4) even though the gripper is portable and easily used, it is strong and durable and may be economically manufactured.

BRIEF DESCRIPTION OF THE DRAWINGS

The above noted and above features of the invention will be better understood from the following detailed description, in which:

FIG. 21 is a perspective view of another portion of the gripper of FIGS. 3 and 4;

FIG. 22 is a perspective view of still another portion of the gripper of FIGS. 3 and 4;

FIG. 23 is a perspective view of still another portion of the gripper of FIGS. 3 and 4;

FIG. 24 is a perspective view of still another portion of the gripper of FIGS. 3 and 4;

FIG. 25 is a perspective view of still another portion of the gripper of FIGS. 3 and 4;

FIG. 26 is a perspective view of still another portion of the gripper of FIGS. 3 and 4.

DETAILED DESCRIPTION

Figure 1:
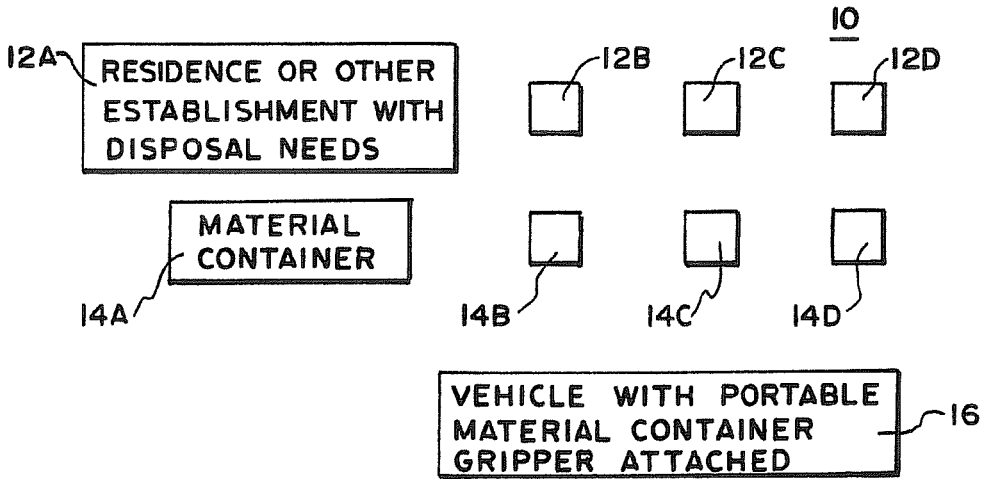
FIG. 1 is a schematic drawing showing the manner in which the portable material container gripper can be used in conjunction with a vehicle and a number of collection sites.

In FIG. 1, there is shown a schematic block diagram 10 illustrating the use of a material handling system in accordance with an embodiment of the invention. As shown in the block diagram 10 of FIG. 1, a plurality of residences 12A-12D or other establishments with disposal needs and a plurality of material containers 14A-14D located at respective ones of the residences or other establishments 12A-12D are serviced by a vehicle 16 having the portable material container gripper attached to the vehicle. In this specification, the words "portable material container gripper" means a relatively lightweight fixture that can be attached both to a lift arm and to a waste container. It includes a movable arm mounting fixture and a material container clamp that permits mounting a material container to a lift arm of a vehicle for dumping material from the material container. In the preferred embodiment, the portable material container gripper weighs less than 150 pounds.

The vehicle with portable material container gripper attached 16 moves from locality to locality at the different ones of the residences 12A-12D and empties the material containers 14A-14D at each locality utilizing the material container gripper. In this process, the gripper is attached to a movable arm of the vehicle at each of the localities and it is also attached temporarily to a respective one of the containers 14A-14D. The movable arm lifts the material container mounted to it by the portable material container gripper and empties it into a bed of the vehicle or other section adapted for storage and then returns the emptied material container to the ground where it may be easily removed by the operator.

The portable material container gripper may be attached to many different types of vehicles and to many types of containers but it is particularly adapted in the preferred embodiment for attachment to a lift arm of a front loader and to the type of container containing horizontal bars. Because it is reasonably lightweight and easily removed and attached to the lift arms, it may be used with any of the vehicles in a fleet of vehicles so that vehicles are not rendered useless because the attaching device is broken nor are the attaching devices unusable for lack of a vehicle. They are relatively inexpensive and spare grippers may be easily kept by an establishment. While a preferred embodiment will be disclosed in detail hereinafter, there are many variations which are possible and variations may be easily constructed for different types of material containers and different types of vehicles while maintaining the portability and easy removable and replaceable characteristics of the material container gripper.

Figure 2:
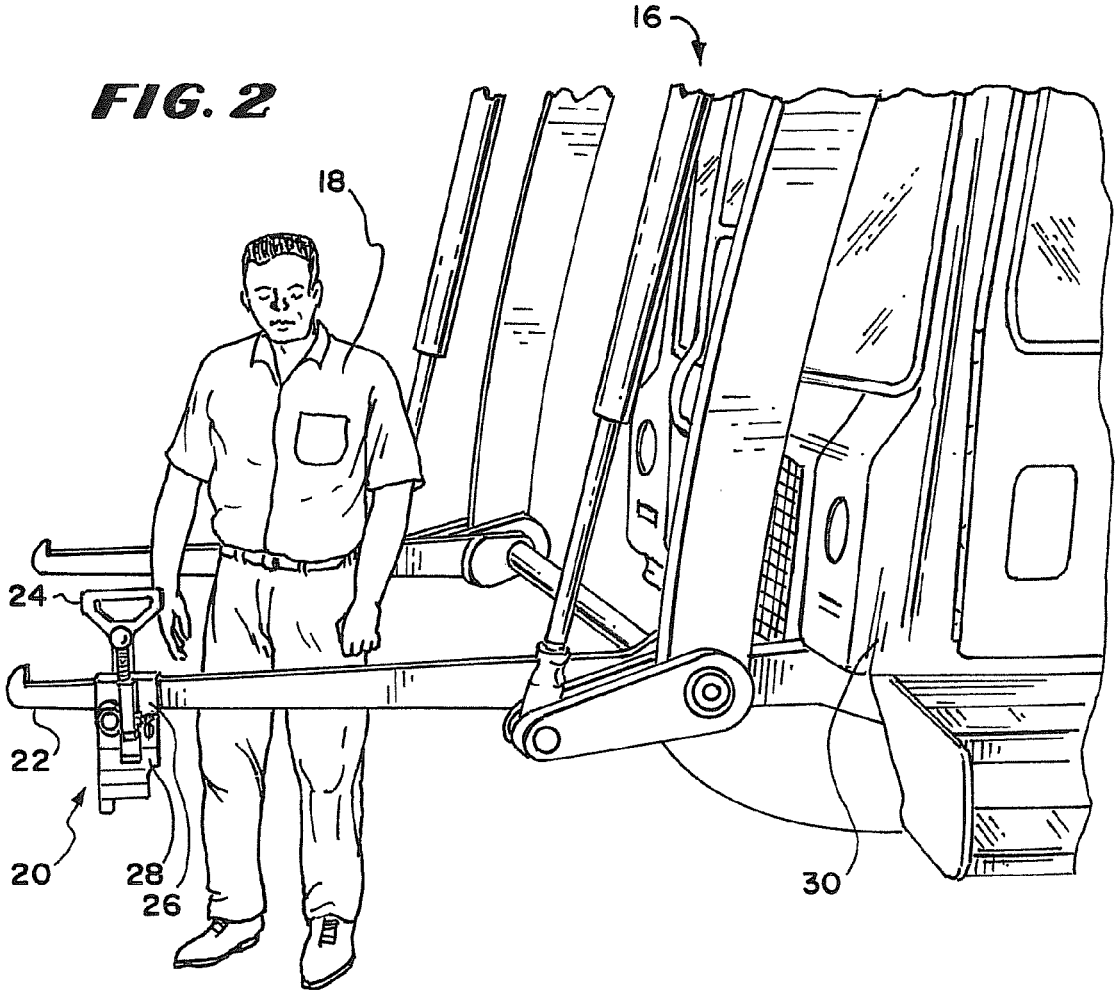
FIG. 2 is a perspective view illustrating the manner in which the portable gripper may be mounted to a lift arm.

In FIG. 2, there is shown a fragmentary simplified perspective view of a vehicle 16 with a portable material container gripper attached and an operator 18 for that vehicle. One such vehicle 30 which may be used as part of the combination of vehicle with portable material gripper attached is a front loader type vehicle having two lift arms one of which is shown at 22 with a portable material container gripper 20 mounted to it to form a combination vehicle and portable material gripper 16. The portable material container gripper 20 has as some of its principal parts a combined spine-handle 24, a movable lift arm mount 26 and a material container clamp 28. While a combined spine-handle 24 is shown in the embodiment of FIG. 2, many different carrying mechanisms and central support and actuating mechanisms are possible. There are other variations which permit fitting to a lift arm and grasping a material container so that the material container may be moved by the lift arm for emptying the contents of the container but the embodiment shown in FIG. 2 has special advantages such as being light and portable and very quick and easy to use.

Although the embodiment of portable material container gripper 20 shown in FIG. 2 includes a combined spine-handle 24 that serves as an actuator to fasten the movable lift arm mount 26 and the material container clamp or hook 28 together to fasten a material container to the lift arm of a suitable vehicle such as a front loader, a separate actuator for fastening the material container clamp and movable lift arm mount is not necessary as each of these two may be separately actuated. Moreover, both may be a clamping device or any other type of fastener which can connect to one of a lift arm and a material container. They may be fastened directly to each other or may have intermediate support members or the like connecting the two.

Figure 4:
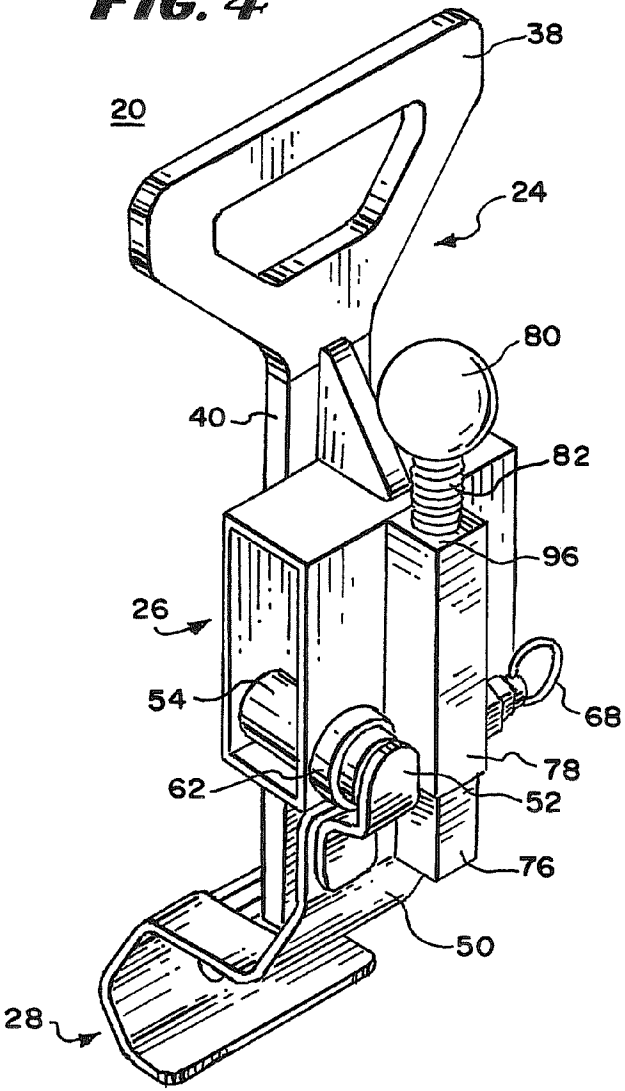
FIG. 4 is a perspective view of the portable gripper taken from another angle.
Figure 3:
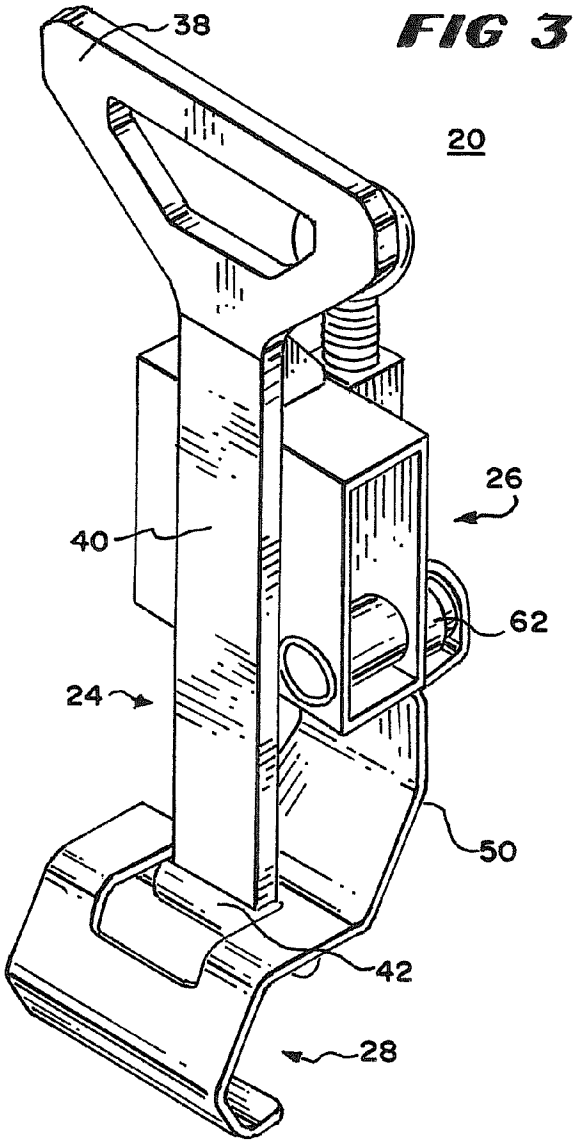
FIG. 3 is a perspective view of the portable gripper of this invention from one angle.

In FIGS. 3 and 4, there are shown perspective views of the same portable material container gripper 20 from different angles each showing the combined spine-handle 24, a movable lift arm mount 26 and a material container clamp or hook 28. In the embodiment of FIGS. 3 and 4, the movable lift arm mount 26 is directly connected to the spine portion 40 of the combined spine-handle 24 such as by welding or the like and the combined spine-handle 24 is typically connected a portion of the material container clamp or hook 28. However, the material container clamp could be rigidly fastened to the combined spine-handle and the movable lift arm mount pivotably mounted.

Figure 5:
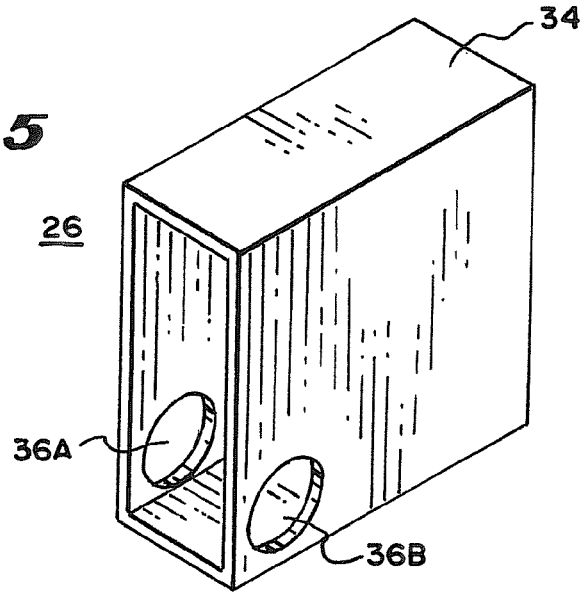
FIG. 5 is a perspective view of one part of the portable gripper of FIGS. 3 and 4.

As best shown in FIGS. 3, 4 and 5, the movable lift arm mount 26 includes a principal holder sized and shaped to be fastened to a lift arm 22. As best shown in FIG. 5, the principal holder in the preferred embodiment is a right regular parallelepiped 34, sized to fit over a lift arm 22 (not shown in FIGS. 3, 4 and 5, shown in FIG. 2). For this purpose, it has relatively elongated five inch vertical walls and two inch horizontal connecting walls. Cylindrical openings 36A and 36B pass through the vertical walls of the movable arm lift mount 26 in one corner and are sized to receive a horizontal locking bar described hereinafter. The horizontal locking bar is positioned to secure the movable lift arm mount 26 to the lift arm 22 (FIG. 2). The movable lift arm mount 26 is fastened such as by welding to the combined spine-handle 24 (FIGS. 3 and 4). With this arrangement, the principal holder 34 may slide over the lift arm 22 (FIG. 2) and be secured in place by inserting the horizontal locking bar through the openings 36A and 36B as described in greater detail hereinafter.

Figure 6:
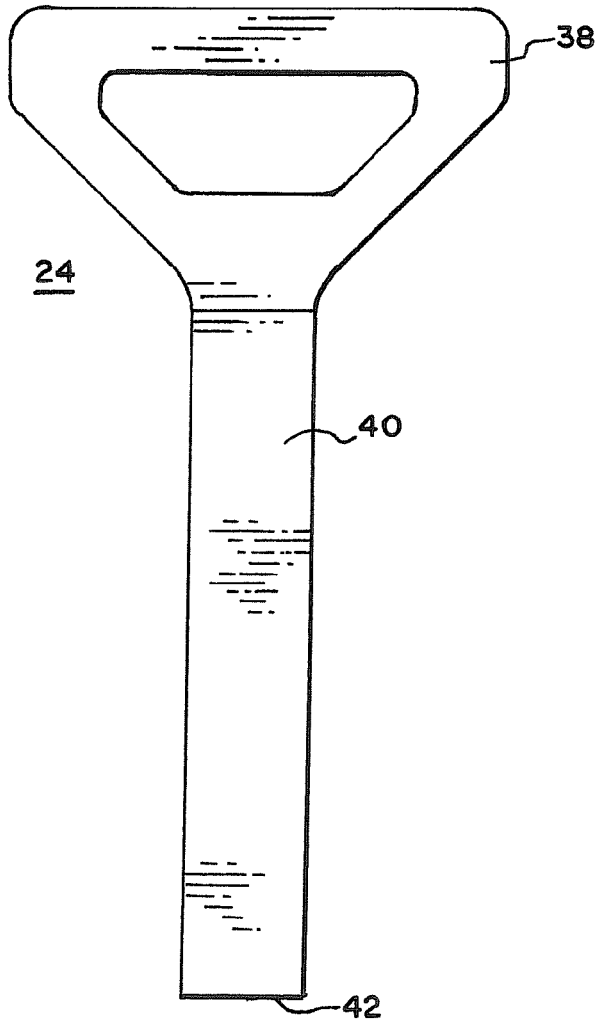
FIG. 6 is an elevational view of another part of the gripper of FIGS. 3 and 4.
Figure 7:
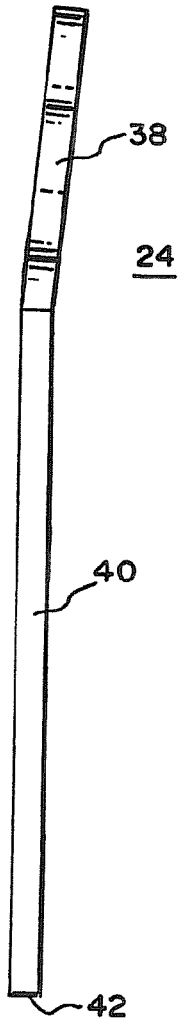
FIG. 7 is a side view of the portion of the gripper shown in FIG. 6.

In FIGS. 3, 4, 6 and 7, there is shown two perspective views, an elevational view and a side view respectively of the combined spine-handle 24 having a handle portion 38, spine portion 40 and a pivotable end 42 (best shown in FIGS. 6 and 7). The handle 38 includes a central opening sufficiently large to be grasped by the operator for carrying the portable material container gripper 20 or for pulling downwardly to pivot the material container clamp 28 to a closed position over a substantially horizontal bar on a material container. In the preferred embodiment, the spine portion 40 is 11 1/16 inches long and the entire combined spine-handle 24 is 16 inches long. It is formed of relatively flat material with a one-half inch thickness. The width of the spine portion 40 is two inches. The handle 38 is slightly bent for ease in grasping to form a five degrees angle from the plane of the spine portion 40. The pivotable end 42 is welded to a tubular cylinder described hereinafter. A pivot pin passes through the central opening of the tubular cylinder to provide pivotable action for the closing of the material container clamp or hook 28 as described hereinafter.

Figure 8:
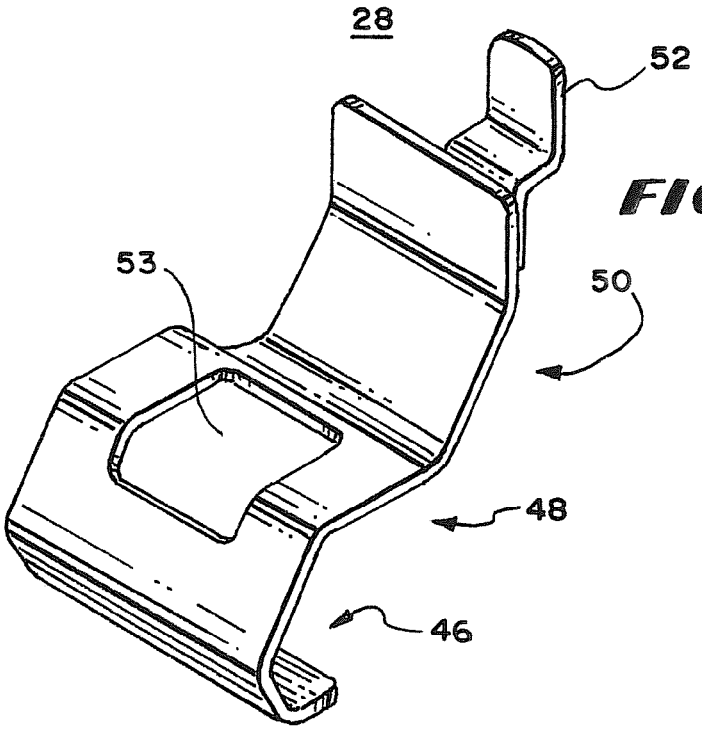
FIG. 8 is a perspective view of another portion of the gripper of FIGS. 3 and 4.
Figure 9:
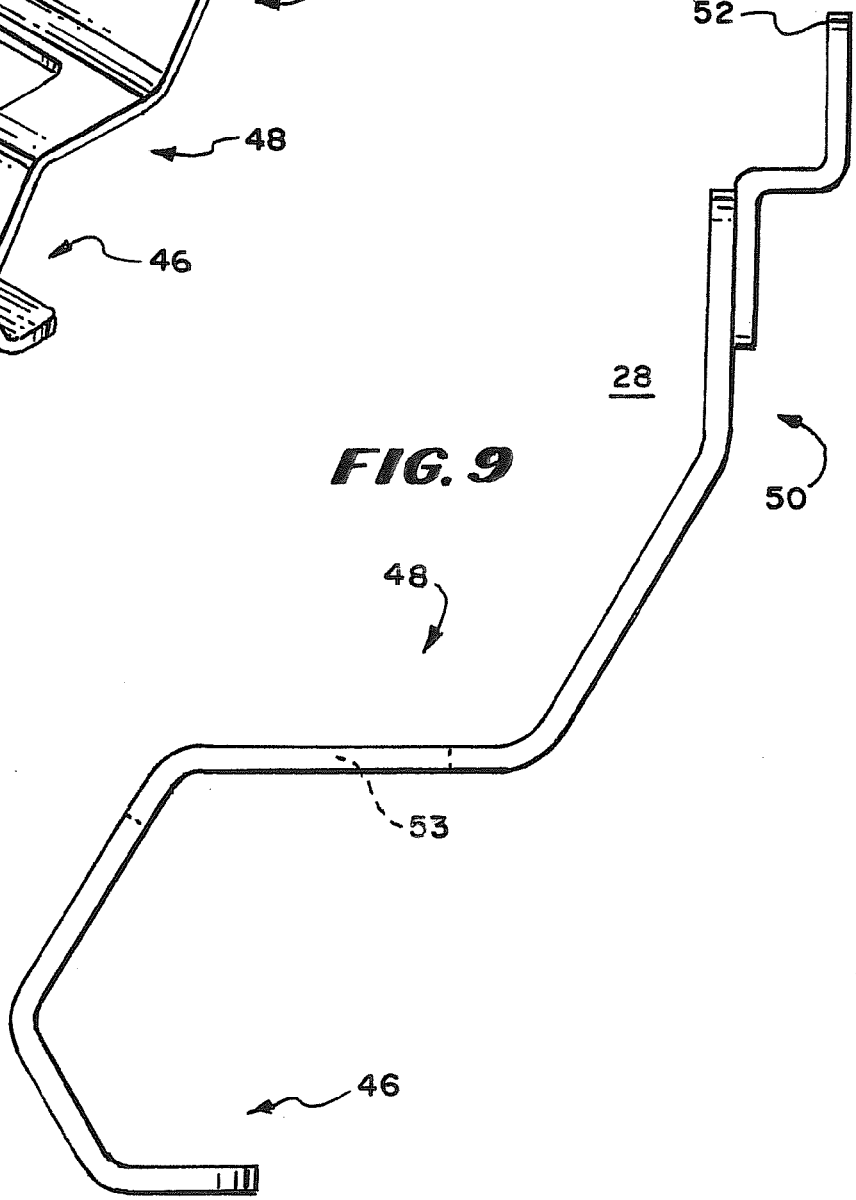
FIG. 9 is a side view of the part shown in FIG. 8.

In FIGS. 8 and 9, there is shown a perspective view and a side view respectively of the material container clamp or hook 28 having a substantially horizontal bar gripping section 46, a pivot section 48 and an actuating section 50. As best shown in FIGS. 8 and 9, the pivot section 48 contains an opening 52 sized to permit the end of the combined spine-handle 24 to move a sufficient distance about the pivot point to permit the bar gripping section 46 to grip a substantially horizontal bar on a material container as described further hereinafter. The actuating section 50 can be manipulated by hand for the purpose of pivoting the material container clamp or hook 28 to grip the material container to fasten it together with the lift arm 22 (FIG. 2) of a vehicle 16 or to release it.

For this purpose, the bar gripping section 46 forms a hook shape on one side of the pivot section 48 while on the other side of the pivot section 48, the actuating section 50 extends at an angle.

Figure 10:
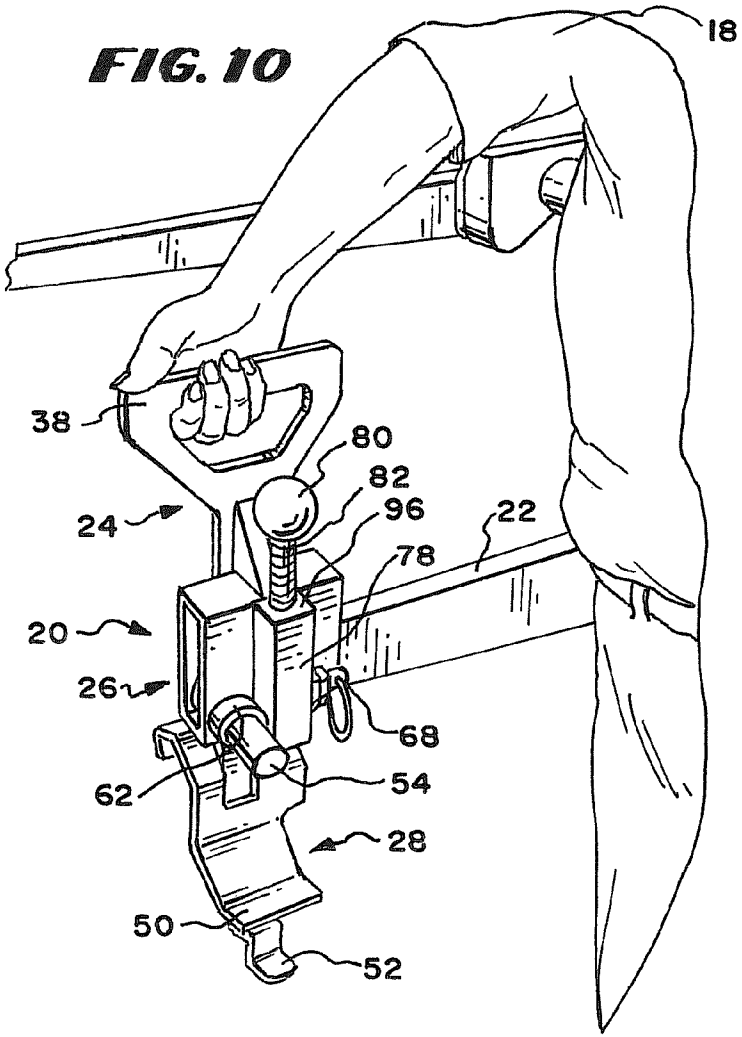
FIG. 10 is a perspective view showing the attachment of the gripper of this invention to the lift arm of a vehicle.

At the end of the actuating section 50, there is a safety bracket 52 positioned to prevent gripping of the material container 14 unless the portable material container gripper 20 is correctly mounted to the lift arm 22 in a manner to be described hereinafter. In FIG. 10, there is shown a perspective view of the portable material container gripper 20 being positioned on the lift arm 22 by an operator 18 holding it by the handle portion 38 of the combined spine-handle 24. As shown in this view, the actuating section 50 of the material container clamp or hook 28 is pulled downwardly, a horizontal lift arm locking bar 54 is pulled out, a vertical material container clamp locking rod 82 is pulled upwardly and a safety pin 68 (FIG. 20) is pulled out.

Figure 11:
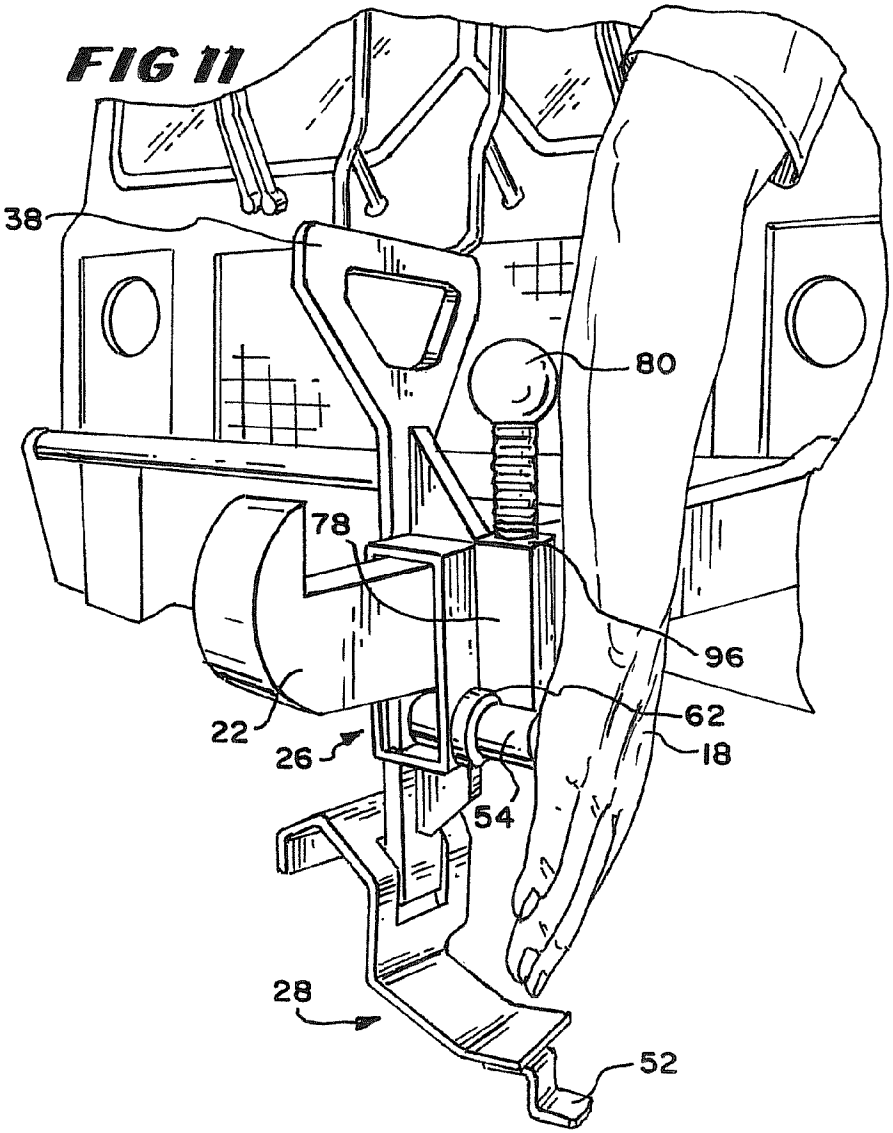
FIG. 11 is a perspective view showing the manner in which the gripper of FIG. 10 is fastened and locked firmly in place on a lift arm.

In FIG. 11, there is shown a perspective view of the operator 18 pushing the horizontal lift-arm locking bar 54 into the interior of the movable lift arm mount 26 where it passes underneath the lift arm 22 to securely lock the lift arm 22 and the movable lift arm mount 26 together so that the portable material container gripper 20 may lift a heavy container upwardly and turn it upside down for dumping without the movable lift arm mount 26 being separated or moving relative to the lift arm 22 itself.

Figure 12:
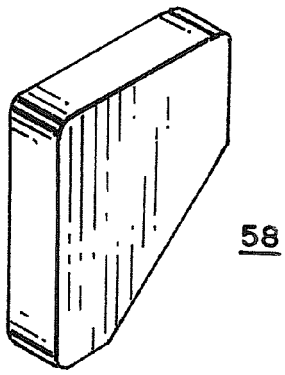
FIG. 12 is a perspective view of still another part of the gripper of FIGS. 3 and 4.

In FIGS. 3, 4 and 12 there is shown a bottom gusset 58 formed as a prism with two narrower edges at right angles to each other connected by other angled sides between flat surfaces. The two sides at right angles to each other are welded respectively to the bottom of the movable lift arm mount 26 and the spine portion 40 of the combined spine-handle 24.

Figure 13:
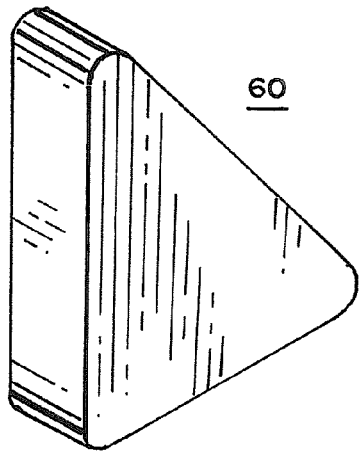
FIG. 13 is a perspective view from another angle of the part of FIG. 12.

In FIGS. 3, 4 and 13, there is shown a top gusset 60 also having two edges at right angles to each other between flat surfaces with one of the edges being welded to the spine portion 40 of the combined spine-handle 24 and the other to the top of the movable lift arm mount 26. These two gussets 58 and 60 provide support on either side and are fastened firmly, preferably by welding to hold the spine portion 40 of the combined spine-handle 24 and movable lift arm mount 26 firmly together as a heavy material container 14 is moved from position to position imposing weight in different directions on the portable material container gripper 20.

Figure 14:
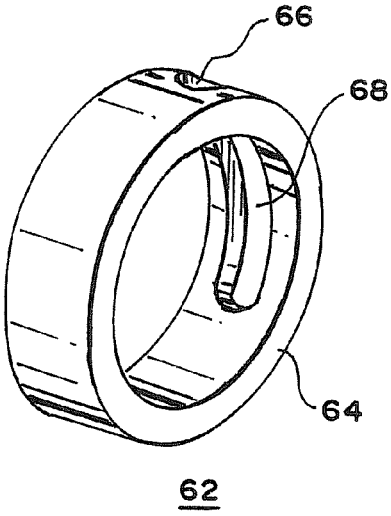
FIG. 14 is a perspective view of still another part of the gripper of FIGS. 3 and 4.

In FIG. 14, there is shown a perspective view of a retaining collar 62 having a cylindrical tubular portion 64, a through slot 66 extending through the cylindrical tubular portion 64 and along the cylinder wall between wall to wall at one side and a pin 68 that fits in the opening of the retaining collar 62. This collar 62 is welded over the opening 36A or 36B in the walls of the movable lift arm mount 26 and the retaining collar 62 and openings 36A and 36B are sized to accommodate the horizontal lift arm locking bar 54 which slides within the collar 62 and the openings 36A and 36B in the movable lift arm mount 26.

Figure 15:
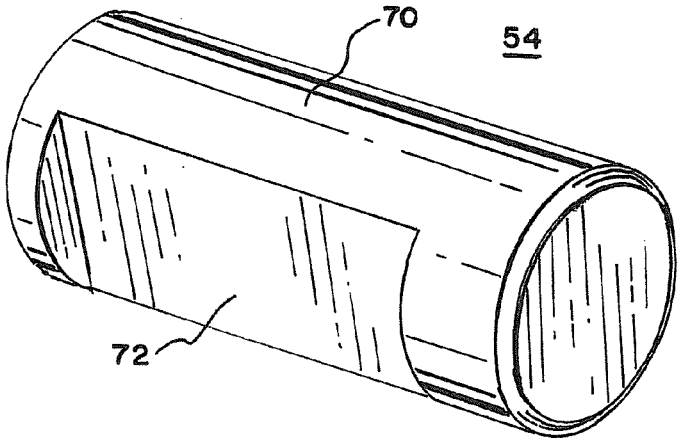
FIG. 15 is a perspective view of still another part of the gripper of FIGS. 3 and 4.

In FIG. 15, there is shown a perspective view of the horizontal lift arm locking bar 54 having a solid cylindrical portion 70 and a cut away portion 72 in one side. The cut away portion 72 is sized to fit within the retaining collar 62 with the pin 68 in place whereas the horizontal lift arm locking bar 54 itself fits within the collar 62 but extends on either side of the pin 68. With this arrangement, the horizontal lift arm locking bar 54 may be inserted within the collar 62 and through the aligned openings 36A and 36B (FIG. 5) in the parallel walls of the movable lift arm mount 26 (FIGS, 2, 3 and 4). The pin 68 may then be inserted in the opening 66 to hold the horizontal lift arm locking bar 54 in place while permitting it to slide through the range of the cut away portion 72. The cut away portion 72 is sufficiently large so that the horizontal lift arm locking bar 54 when moved outwardly permits the lift arm 22 to be inserted into the movable lift arm mount 26 (FIGS. 2-5, 10 and 11) and when pushed in, fully holds the lift arm 22 securely in place within the movable lift arm mount 26.

In the preferred embodiment, the movable lift arm mount 26 (FIG. 5) includes side walls that are approximately five inches high jointed by horizontal walls approximately two inches long. The thickness of all four walls is approximately 3/16 of an inch. Parallel openings 36A and 36B (FIG. 5) are centered 0.875 of an inch from a side edge and 0.815 of an inch from a bottom side. It has a diameter of 1.256 inches. The horizontal lift arm locking bar 54 (FIG. 15) has an outside diameter of approximately 1.25 inches with a length a three inches. The cutaway portion is 2.75 inches long and is cut to a depth of 0.375 of an inch. Its outward start is 0.595 of an inch from one end.

Figure 16:
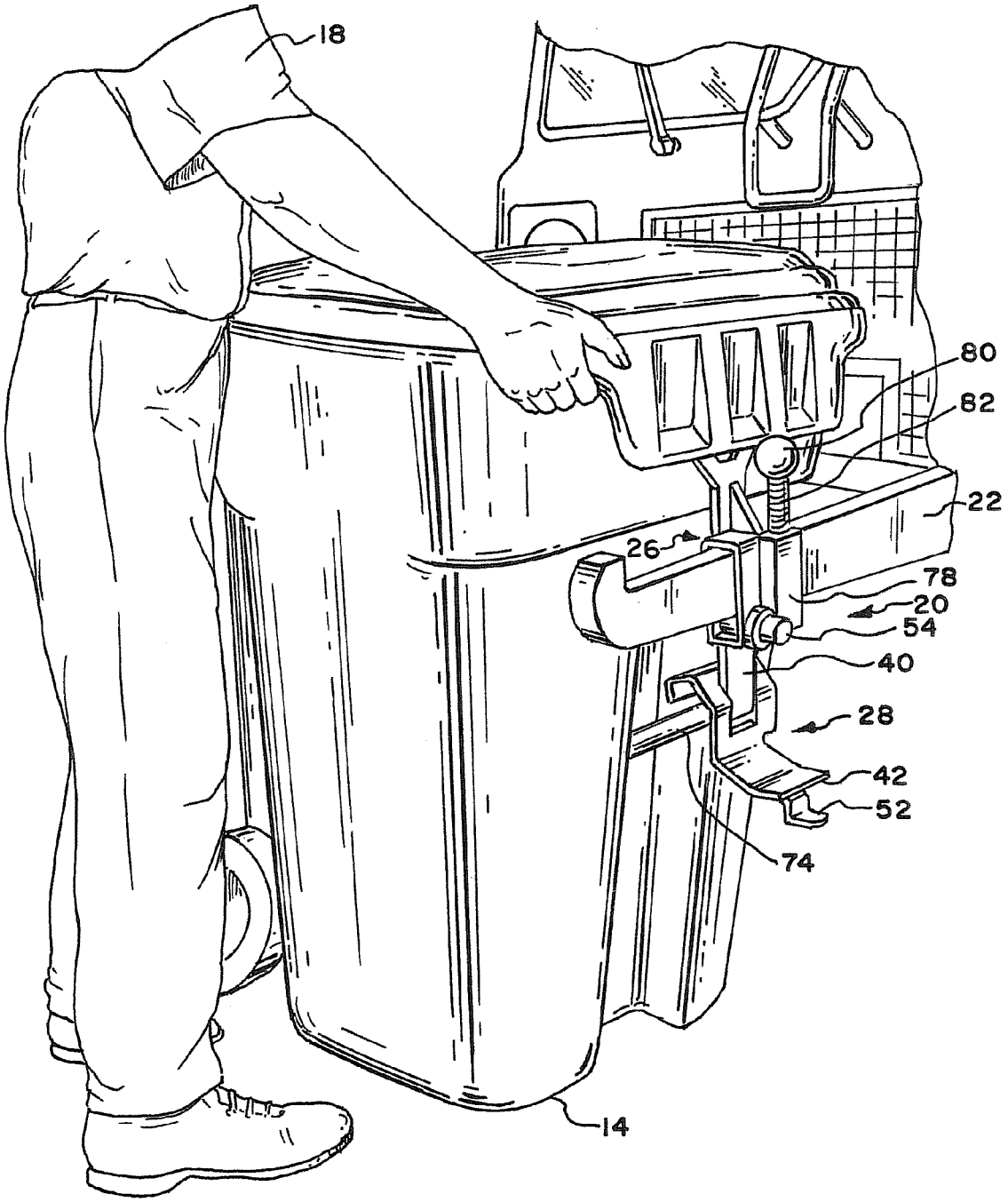
FIG. 16 is a perspective view of an operator connecting a material handling container to the gripper of FIGS. 3 and 4 while it is fastened to the lift arm of a vehicle.

In FIG. 16, there is shown a simplified fragmentary perspective view of an operator 18 positioning a waste container 14 with a substantially horizontal bar 74 in juxtaposition with a portable material container gripper 20. As shown in FIG. 16, the waste material container 14 is positioned so that the substantially horizontal bar 74 is within the material container clamp or hook 28 with the movable lift arm mount 26 mounted on the lift arm 22. The material container clamp or hook 28 is positioned downwardly about the pivotal end 42 of the portable material container gripper 20. In this specification, the term "substantially horizontal bar" means an elongated member attached to a material or waste container 14 and sized to fit within a material container clamp or hook 28 of a portable material container gripper 20. The largest distance perpendicular to its longitudinal axis (diameter if it is cylindrical) is less than 6 inches. It is between a horizontal position and a position less than 40 degrees from the horizontal. Horizontal is a direction parallel to the material container's bottom As shown in FIGS. 2-4, 10, 11 and 16, the portable material container gripper 20 includes a locking bar 76, a locking tube 78, a ball knob 80, a locking rod 82, locking rod sleeve 84 and a helical spring 86. The locking bar 76 is mounted to the knob 80 by the locking rod 82. The bar, rod and knob 80 are biased upwardly by the helical compression spring 86 that is mounted around the sleeve 84 between the top of a parallelepiped shaped locking tube 78 and the knob 80 so that the locking bar 76 is biased upwardly. The locking tube 78 is shaped as a parallelepiped tube with a locking tube cap 96 at its top to support the end of the spring 86. In the position in FIG. 16, the knob 80 and locking tube 78 are positioned upwardly and the vertical material container clamp locking bar 92 is positioned within the locking tube 78.

Figure 17:
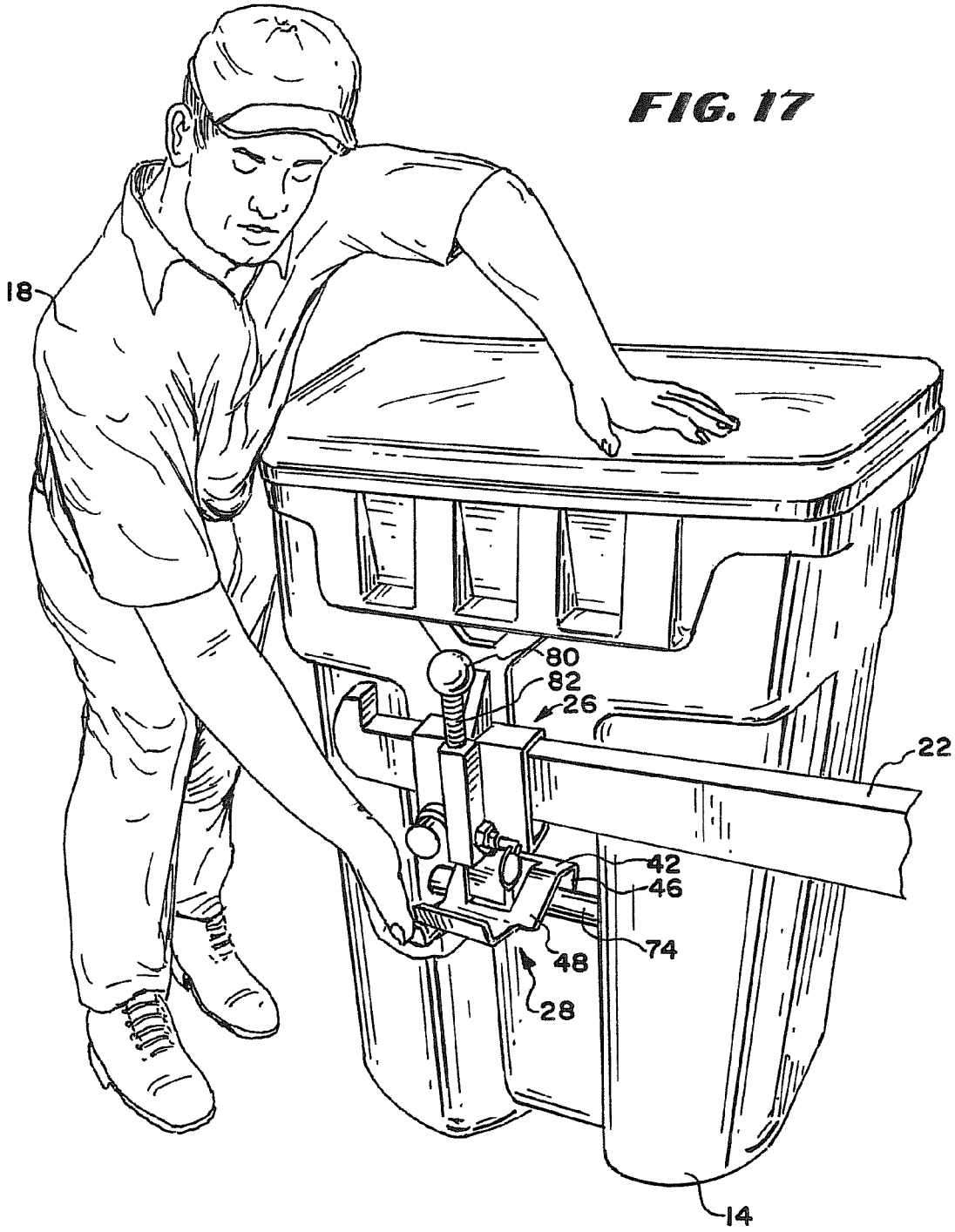
FIG. 17 is a perspective view of an operator locking the container of FIG. 16 in place to connect the container to the lift arm of a vehicle.

In FIG. 17, there is shown a fragmentary perspective view of an operator 18 pulling upwardly on the end of the material clamp or hook 28 to cause it to pivot about the pivotal end 42 in the pivot section 48 to cause the bar gripping section 46 to grip the substantially horizontal bar 74 of the material container 14 and thus enable the portable material container gripper 20 to mount the material container 14 to the lift arm 22 of the vehicle 16 (FIG. 2). With this arrangement, an operator can quickly connect the substantially horizontal bar of the material container 14 to the movable lift arm mount 26 of the portable material container gripper 20 so that it is fastened thereon.

Figure 18:
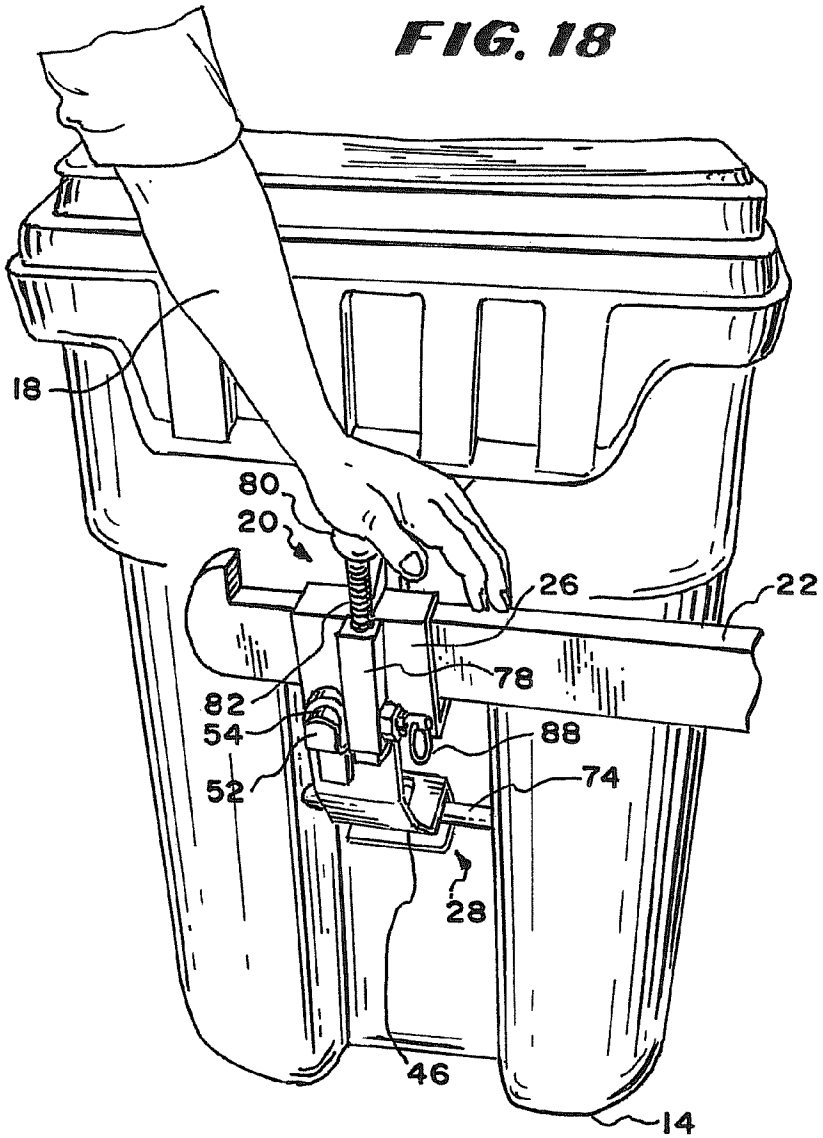
FIG. 18 is a perspective view showing another step of locking the container to the lift arm.

In FIG. 18, there is shown a fragmentary view of an operator 18 pushing downwardly on the knob 80 of the locking rod 82 with the safety bracket 52 over the lift arm locking bar 54. With this arrangement, the clamp 28 cannot be closed about the substantially horizontal bar 74 of the material container 14 unless the lift arm locking bar 54 has been depressed to secure the movable lift arm mount 26 to the lift arm 22 so that the material container 14 will not be loose on the lift arm 22, thus providing a safety factor. When the lift arm locking bar 54 is depressed, a spring loaded safety pin 88 snaps in place through an opening in the vertical material container clamp locking bar 76 (not shown in FIG. 18, shown in FIG. 4). This holds the locking bar downwardly to hold the bar gripping section 46 of the portable material container gripper 20 in its closed position about the substantially horizontal bar 74 of the material container 14.

With this arrangement, independent double locks are provided for the movable lift arm mount 26 and the container clamp 28 to avoid accidents. In the specification, the language "independent lift arm and material container locks" means an arrangement in which a holding device for the lift arm 22 is held firmly in place about the lift arm 22 by a first device that must be manually removed before the holder 28 on the lift arm 22 is free to move and another device that must be manually removed from the material container 14 before the material container 14 is free to move with respect to the portable material container gripper 20.

Figure 20:
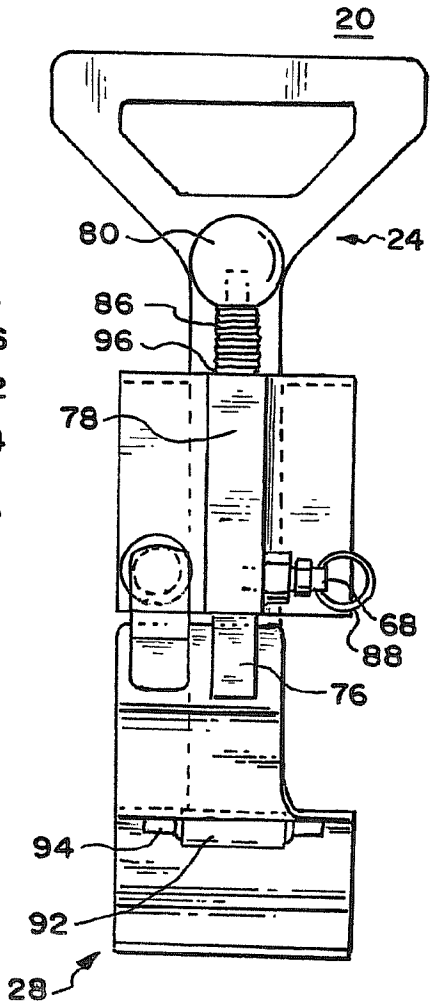
FIG. 20 is a front view of the gripper of the FIG. 19.
Figure 19:
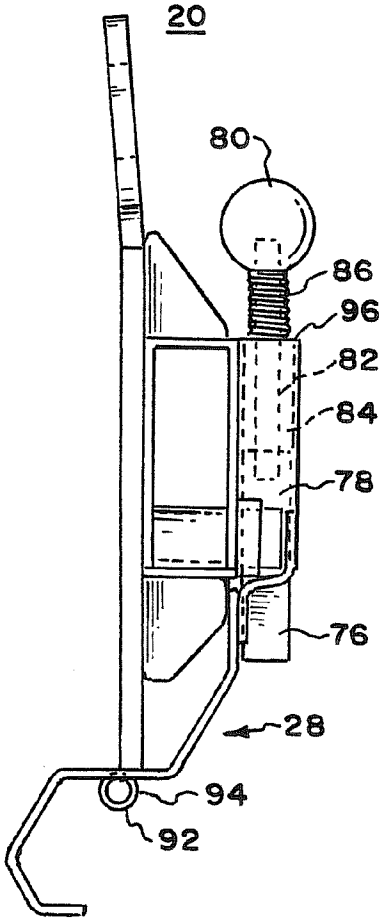
FIG. 19 is a side view of the gripper illustrating its construction in an open position.

In FIGS. 19 and 20, there are shown respectively a side view and a front view of the portable material container gripper 20 showing the manner in which a lower pivot tube 92 in the pivot section 48 enables pivoting of the material container clamp or hook 28. As best shown in FIG. 20, a pivot pin 94 is welded to the material container clamp or hook 28. The pivot tube 92 is welded to the bottom of the spine portion 40 (FIG. 6) at the pivotal end 42 of the combined spine-handle 24 to permit pivoting of the material container clamp or hook 28 with respect to the combined spine-handle 24.

As best shown in FIGS. 4, 19 and 20, the locking rod 82 is threaded into the knob 80 and extends through the locking rod sleeve 84. The helical compression spring 86 extends from the knob 80 to the cap 96 of the locking tube 78 to bias the knob 80, rod and locking bar upwardly with the sleeve being shorter than the helical spring in its expanded state to limit movement downwardly of the vertical locking bar 76. The locking rod 82 (FIG. 17) extends into and is threaded into the locking bar 76. The locking rod 82 is welded to the locking bar 76. With this arrangement, when the locking bar 76 is moved downwardly by pressing on the knob 80, the locking bar 76 locks the clamp 28 in place and is positively locked by a spring loaded safety pin 88. When the spring loaded safety pin 88 is manually pulled out, the compression spring 86 moves the knob 80 and locking bar 78 upwardly so that the clamp 28 may be manually removed from the lift arm.

To receive the spring loaded safety pin 88 and maintain alignment between the locking bar 76 and locking rod 82, the square locking bar 76 fits within the locking tube 78 with a close tolerance that permits movement upwardly and downwardly within the locking bar 76. It includes an opening alignable with the opening in the locking tube 78 so that the spring loaded safety pin 88 is forced by its spring pressure through both the opening in the square locking tube 78 and the square aligning bar 76 to lock the locking bar 76 in place and hold the clamp 28 firmly. The top of the locking bar 76 is welded to the bottom of the locking rod sleeve 84 and sized to extend below the locking tube 78 when the knob 80 is fully depressed and locked in place by the spring loaded safety pin 88.

In FIG. 21, there is shown a perspective view of the locking tube 78 having an opening 100 at its base sized to receive the spring loaded safety pin 88. This tube 78 is welded to the spine portion 40 of the combined spine-handle 24 to receive the square aligning bar 76. In FIG. 22, there is shown a perspective view of the locking cap 96 sized to fit within the top of the locking tube 78 and be welded thereto. It includes a central cylindrical opening 102 having a diameter sized to receive the locking rod 82 with a loose movable fit.

In FIG. 23, there is shown a perspective view of the locking rod sleeve 84 having an internal diameter 106 sized to receive the locking rod 82 and an external diameter 104 sized to be larger than the opening 102 (FIG. 22) in the locking cap 96. It has a length shorter than the distance between the knob 80 and the top of the locking tube 78 when the knob 80 is fully extended but sufficiently short so that when the knob 80 is pressed until the spring loaded safety in 88 locks the locking tube 78 in place, the locking bar 76 extends outwardly from the locking tube 78 to lock the material container clamp or hook 28 in place and thus prevent the substantially horizontal bar 74 from freeing itself from the lift arm 22 of the vehicle 16.

In FIG. 24, there is shown a perspective view of the locking rod 82 having a bottom end 112 that is welded to the square aligning bar 76, an external diameter 110 sized for a loose fit through the opening 102 (FIG. 22) in the locking cap 96 (FIG. 22) and sized for a loose fit within the cylindrical central opening 106 (FIG. 23) of the rod sleeve 84 (FIG. 23). At its upper end are recessed external threads 108 sized to be threaded into a tapped bore within the knob 80. With this arrangement, the knob 80 may be threaded onto the locking rod 82. The locking rod 82 extends downwardly and is held within the locking tube 78 by the welded square aligning bar 76 (FIGS. 19 and 20). At its upper end, the knob 80 and the top of the locking tube 78 hold the helical compression spring 86 in place.

In FIGS. 25 and 26, there are shown respectively perspective views of the lower pivot tube 92 and the lower pivot pin 94. The pivot tube 92 has an external diameter 116 welded to the combined spine-handle 24 at the bottom of its spine portion 40 and an internal diameter 114 sized for a loose rotatable fit with the external diameter 118 of the lower pivot pin 94. The lower pivot pin 94 is welded to the material container clamp or hook 28 to permit pivoting of the clamp or hook 28 with respect to the spine portion 40 of the combined spine-handle 24.

Although a preferred embodiment of the invention is described with some particularity, many modifications and variations may be made without deviating from the invention.

Accordingly, it is to be understood that within the scope of the appended claims, the invention may be practiced other than as specifically described.

What is claimed is:

1. A method for temporarily altering a function of a movable lift arm of a vehicle enabling the movable lift arm to securely couple to a horizontal-bar material container, comprising the steps of:

connecting a portable material container gripper to a movable lift arm of a vehicle, the gripper sized to be held in place when connected to the movable lift arm, the movable lift arm configured for coupling to and lifting a container other than the horizontal-bar material container, the portable material container gripper configured for detachable connectivity to the movable lift arm allowing the movable lift arm, with the portable material container gripper removed, to return to a service coupling to and lifting the container other than the horizontal-bar material container;

moving the vehicle from location to location;

gripping at least one horizontal-bar material container at least at one of said locations with the portable material container gripper; and dumping contents of the at least one horizontal-bar material container by moving the movable lift arm of the vehicle.

2. A method in accordance with claim 1 wherein the step of connecting a portable material container gripper to a movable lift arm of a vehicle includes the steps of:

moving the portable material container gripper over the movable lift arm with a movable lift arm mount positioned around the movable lift arm; and inserting a locking bar into the movable lift arm mount to hold the portable material container gripper in place on the movable lift arm of the vehicle.

3. A method in accordance with claim 1 wherein the step of gripping at least one horizontal-bar material container at least at one of said locations with the portable material container gripper includes the steps of:

positioning the at least one horizontal-bar material container with a substantially horizontal bar that is part of the at least one horizontal-bar material container in juxtaposition with a material container clamp that is part of the portable material container gripper; and pivoting the material container clamp to clamp the substantially horizontal bar, whereby the at least one horizontal-bar material container is connected to the portable material container gripper.

4. A method in accordance with claim 3 further including the step of inserting a locking bar into the movable lift arm mount to hold the portable material container gripper in place on the movable lift arm of the vehicle wherein a safety bracket on the material container clamp has clearance to move into a closed position about the substantially horizontal bar that locks this position when not inserted into the movable lift arm.

5. A method of emptying a horizontal-bar material container, comprising the steps of:

mounting a portable material container gripper to a movable lift arm, the gripper sized to be held in place when mounted to the moveable lift arm, the movable lift arm configured for coupling to and lifting a container other than the horizontal-bar material container, the portable material container gripper configured for detachable mounting to the movable lift arm allowing the movable lift arm, with the portable material container gripper removed, to return to a service coupling to and lifting the container other than the horizontal-bar material container;

connecting the portable material container gripper to a substantially horizontal bar on the horizontal-bar material container; and moving the lift arm to dump the horizontal-bar material container.

6. A method in accordance with claim 5 wherein the step of mounting a portable material container gripper to a movable lift arm comprises the steps of:

moving the portable material container gripper over the movable lift arm with a movable lift arm mount positioned around the movable lift arm; and inserting a locking bar into the movable lift arm mount to hold the portable material container gripper in place on the movable lift arm of the vehicle.

7. A method in accordance with claim 5 wherein the step of connecting the portable material container gripper to a substantially horizontal bar on the horizontal-bar material container includes the steps of:

positioning the horizontal-bar material container with the substantially horizontal bar that is part of the horizontal-bar material container in juxtaposition with a material container clamp that is part of the portable material container gripper; and pivoting the material container clamp to clamp the substantially horizontal bar with a bar gripping section of the material container clamp and locking the material container clamp in place with an actuating section of the material container clamp, whereby the horizontal-bar material container is connected to the portable material container gripper.

8. A method of gripping a material container, comprising the steps of:

carrying a portable material container gripper by a combined spine-handle to a vehicle having a movable lift arm;

mounting the portable material container gripper to the lift arm;

locking the portable material container gripper to the lift arm;

moving the material container to the portable material container gripper;

actuating a bar gripping section on the portable material container gripper to grip a horizontal bar on the material container;

locking the bar gripping section to the material container; and lifting the material container and dumping its contents.

9. A material collection system, comprising:

a portable material container gripper;

said portable material container gripper detachably coupled to a movable lift arm of a vehicle, the gripper sized to be held in place when coupled to the movable lift arm, the movable lift arm configured for coupling to and lifting a container other than a horizontal-bar material container, the portable material container gripper configured for detachable coupling to the movable lift arm allowing the movable lift arm, with the portable material container gripper detached, to return to a service coupling to and lifting the container other than the horizontal-bar material container;

said portable material container gripper including a clamp arranged to secure the horizontal-bar material container to the portable material container gripper;

said vehicle including apparatus for actuating the movable lift aim of the vehicle wherein contents of the horizontal-bar material container are dumped by moving the movable lift arm of the vehicle.

10. A dumping system, comprising:

a plurality of horizontal-bar material containers;

a portable material container gripper;

said portable material container gripper including a mounting fixture configured to detachably mount the portable material container gripper to a movable lift arm of a vehicle, the gripper sized to be held in place when mounted to the movable lift arm, the movable lift arm designed for coupling to and lifting a container other than the horizontal-bar material container, the portable material container gripper configured for detachable mounting to the movable lift arm allowing the movable lift arm, with the portable material container gripper detached, to return to a service coupling to and lifting the container other than the horizontal-bar material container;

said horizontal-bar material containers each including a different one of a plurality of substantially horizontal bars, wherein the portable material container gripper connects the substantially horizontal bars on the horizontal-bar material containers to the movable lift arm for dumping contents of the horizontal-bar material containers.

11. A dumping system according to claim 10 wherein the mounting fixture configured to mount the portable material container gripper to a movable lift arm of a vehicle includes a tube sized to fit around the movable arm of a vehicle and a lock for holding the tube to the movable arm.

12. A dumping system according to claim 11 wherein the lock includes a bar and openings in the tube to receive the bar.

13. A dumping system according to claim 10 further including a clamp and a spine-handle; said tube being rigidly connected to the spine-handle and said clamp being pivotally mounted to said spine-handle wherein the clamp may be pivoted between a closed position about a horizontal bar on a material container and an open position.

14. A portable material container gripper, comprising:

a combined spine-handle;

a movable arm mounting fixture adapted to be mounted to the combined spine-handle wherein the combined spine-handle may be removably mounted to a lift arm; and a clamp positioned to be opened and shut by the combined spine-handle.

* * * * *